US006889842B2

(12) United States Patent
Sandlin et al.

(10) Patent No.: US 6,889,842 B2
(45) Date of Patent: May 10, 2005

(54) APPARATUS AND METHOD FOR DRY BENEFICIATION OF COAL

(75) Inventors: James David Sandlin, Bainbridge, GA (US); Lewis M. Carter, Jr., Donalsonville, GA (US)

(73) Assignee: Lewis M. Carter Manufacturing Co., Donalsonville, GA (US)

( * ) Notice: Subject to any disclaimer, the term of this patent is extended or adjusted under 35 U.S.C. 154(b) by 315 days.

(21) Appl. No.: 10/147,764

(22) Filed: May 16, 2002

(65) Prior Publication Data

US 2003/0183558 A1 Oct. 2, 2003

Related U.S. Application Data

(60) Provisional application No. 60/367,603, filed on Mar. 26, 2002.

(51) Int. Cl.[7] ..... B03B 7/01; B07B 9/01

(52) U.S. Cl. ..... 209/20; 209/21; 209/24; 209/30; 209/44; 209/466; 209/477

(58) Field of Search ..... 209/19, 20, 21, 209/23, 29, 24, 466, 477

(56) References Cited

U.S. PATENT DOCUMENTS 2,012,633 A * 8/1935 Meunier ..... 209/466
2,014,249 A * 9/1935 Fletcher ..... 209/321

(Continued)

FOREIGN PATENT DOCUMENTS

EP 0 081 087 11/1982 ..... B03B/9/00
GB 407376 3/1934 ..... B03B/4/00

OTHER PUBLICATIONS

PCT, *International Search Report*, Mailed Jul. 8, 2003, European Patent Office (4 pages).
Alderman and Snoby, *Technical Report TR–01*, Presented at 2001 SME Meeting, Denver, Colorado, Feb. 26–28, 2001.
Lewis M. Carter Manufacturing Co., Inc., *Gravity Separators*, Brochure (4 pages).
Lewis M. Carter Manufacturing Co., Inc., "*MARC" Series Gravity Separators*, Brochure (2 pages).

(Continued)

*Primary Examiner*—Donald P. Walsh
*Assistant Examiner*—Jonathan R Miller
(74) *Attorney, Agent, or Firm*—Wood, Herron & Evans, LLP

(57) ABSTRACT

A method of beneficiating coal in a dry process includes separating raw coal from a coal mine into coal fines and larger pieces of coal using pressurized air, separating the larger pieces of coal according to size, removing ash from the larger pieces of coal on an air table, and further removing ash from the larger pieces of coal using a size-discriminating device to obtain a beneficiated coal product. The invention also includes an apparatus for the dry beneficiation of coal. The apparatus includes at least one air separating device, at least one air table, and at least one first and second shakers which separate the coal by size and remove ash from the coal. The air table effectively removes ash from infed coal without the need for a fluidizing media.

34 Claims, 5 Drawing Sheets

U.S. PATENT DOCUMENTS

| | | | | | |
|---|---|---|---|---|---|
| 2,291,661 | A | * | 8/1942 | Stump | 209/475 |
| 3,444,996 | A | | 5/1969 | Douglas et al. | 209/44 |
| 3,774,759 | A | | 11/1973 | Weintraub et al. | 209/474 |
| 4,194,971 | A | | 3/1980 | Beeckmans | 209/467 |
| 4,360,423 | A | | 11/1982 | Fugate | 209/17 |
| 4,408,723 | A | | 10/1983 | Adrian et al. | 241/19 |
| 4,461,625 | A | | 7/1984 | Smith et al. | 44/10 R |
| 4,506,608 | A | | 3/1985 | Strohmeyer, Jr. | 110/245 |
| 4,529,506 | A | | 7/1985 | Smit | 209/13 |
| 4,576,102 | A | | 3/1986 | Rasmussen et al. | 110/346 |
| 5,197,398 | A | | 3/1993 | Levy et al. | 110/347 |
| 5,392,922 | A | | 2/1995 | Chen | 209/20 |
| 5,769,242 | A | | 6/1998 | Strangalies | 209/455 |
| 5,791,496 | A | | 8/1998 | Strangalies | 209/455 |
| 5,794,791 | A | | 8/1998 | Kindig | 209/727 |
| 5,996,808 | A | * | 12/1999 | Levy et al. | 209/474 |
| 6,036,028 | A | | 3/2000 | Jungmann et al. | 209/732 |
| 6,142,311 | A | | 11/2000 | Korber | 209/454 |
| 6,422,392 | B1 | * | 7/2002 | Levy | 209/11 |
| 6,425,485 | B1 | * | 7/2002 | Mankosa et al. | 209/164 |
| 6,467,631 | B2 | * | 10/2002 | Strangalies et al. | 209/474 |
| 2002/0000401 | A1 | | 1/2002 | O'Connor et al. | 209/691 |

OTHER PUBLICATIONS

Lewis M. Carter Manufacturing Co., Inc., *Farmer's Stock Receiving Shaker*, Brochure (2 pages).

Lewis M. Carter Manufacturing Co., Inc., *ROCA Stoner*, Brochure (2 pages).

Lewis M. Carter Manufacturing Co., Inc., *Shakers*, Brochure (6 pages).

Lewis M. Carter Manufacturing Co., Inc., *FT Rotary Airlocks*, Brochure (2 pages).

Lewis M. Carter Manufacturing Co., Inc., *Vibratory Conveyors*, Brochure (6 pages).

Lewis M. Carter Manufacturing Co., Inc., *Elevators*, Brochure (4 pages).

PCT, *International Preliminary Examination Report*, Completed Jun. 18, 2004, European Patent Office (7 pages).

* cited by examiner

APPARATUS AND METHOD FOR DRY BENEFICIATION OF COAL pursuant to 37 C.F.R. § 1.78(a)(4), this application claims the benefit of and priority to prior filed co-pending Provisional Application Ser. No. 60/367,603, filed Mar. 26, 2002, which is expressly incorporated herein by reference.

FIELD OF THE INVENTION

The present invention generally pertains to the processing of coal, and more particularly to the dry beneficiation of coal.

BACKGROUND OF THE INVENTION

Raw coal which has been removed from a coal mine is generally referred to as run-of-mine coal and comprises coal and noncoal material. The noncoal material is generally referred to as ash and comprises pyrite clays and other aluminosilicate materials. If these noncoal ash materials are left in the run-of-mine coal, they create problems during combustion, such as slagging, fouling and a general decrease in combustion efficiency. In addition, the ash materials create pollution problems when burned with the coal. In particular, burning of coal with high ash content generates sulfur dioxide, which is typically required by law to be removed by utilities which burn the coal. Specifically, laws, such as the Clean Air Act in the United States, place limitations on the amount of sulfur dioxide which can be emitted by such facilities.

One way to reduce emissions and alleviate other environmental concerns is to remove the noncoal material from the run-of-mine coal prior to combustion. "Beneficiation" refers to the removal of noncoal material from raw coal to produce a relatively clean coal product. Processes for the beneficiation of coal may generally be classified as either wet processes or dry processes. Currently, wet beneficiation processes are the most predominant in industry. These processes use either water or other liquid materials in a manner that takes advantage of the difference in density of the coal and ash materials in order to separate the coal from the ash. In these wet processes, the run-of-mine coal must generally be pulverized into relatively fine coal particles in order to effectuate adequate separation of the coal and ash.

Dry beneficiation processes also take advantage of the differences between the densities of the coal and ash to clean the coal, but without utilizing water. Conventional dry beneficiation processes generally utilize a fluidizing bed, containing a fluidizing media (such as magnetite) with a density intermediate the coal and ash materials, to stratify a mixture of run-of-mine coal and the media into layers of coal and ash using pressurized air. In some arrangements, the fluidizing bed is also vibrated to take further advantage of the density differences while cleaning the coal. One drawback of these prior dry beneficiation processes is that the fluidizing media must generally be separated from the cleaned coal subsequent to removing the ash.

Wet processing has generally been utilized over dry processing methods because, heretofore, it has been difficult to obtain high calorific values for coal which has been beneficiated in a dry process. The caloric value of coal is a measure of the combustion efficiency. The wet processes, however, also have various drawbacks. Wet processing, for example, necessarily adds moisture to the beneficiated coal. This moisture decreases the combustion efficiency, or calorific value, and the wet processed coal must generally be dried prior to combustion. The additional steps and apparatus required to dry the wet processed coal increases the overall cost of the process. Added moisture to the coal also makes the coal susceptible to freezing in cold climates. On the other hand, in areas where the climate is very dry, water may not be readily available or there may be prohibitions against using water for applications where the water cannot be added back to the water cycle.

Wet processing methods also suffer from various handling issues. Because the run-of-mine coal must be pulverized to a very small size, wet processes may not be effective for cleaning extremely fine coal and pyrite particles due to surface phenomenon which interfere with the separation process. Furthermore, very small coal particles are harder to dry in mechanical processes, which generally utilize pressurized air. Fine particles of wet coal are also difficult to transport through automated machinery and to handle in bulk. Finally, the equipment outlay for wet processing of coal is generally more expensive compared to the equipment outlay required for dry processing of coal. Perhaps the most significant drawback of wet beneficiation of coal is the environmental impact, namely the generation of sulfuric acid as a bi-product of the process.

There is thus a need for an apparatus and method of beneficiating coal in a dry process which results in a coal product that exhibits sufficiently high calorific value and which overcomes drawbacks of the prior art such as those mentioned above.

SUMMARY OF THE INVENTION

The present invention provides a method and apparatus for dry beneficiation of coal which produces a clean coal product having a higher calorific value than has generally been possible with previous dry beneficiation methods and devices. Furthermore, the method of the present invention provides a beneficiated coal product with less environmental impact than prior art wet processing methods, and the apparatus of the invention generally requires less capital outlay for construction and maintenance than is necessary for conventional wet processing methods.

In one aspect of the invention, a method for the dry beneficiation of coal includes separating raw coal from a coal mine into coal fines and larger pieces of coal using pressurized air; separating the larger pieces of coal, according to size, into at least one first group; conveying each first group to an air table; separating ash from the first group with the air table; and separating ash, using a size-discriminating device, to obtain a beneficiated coal product. In another aspect of the invention, the size-discriminating devices are shakers having screens with openings sized to either separate coal into different groups or to remove ash from the coal. In another exemplary aspect of the invention, large pieces of raw coal from the mine are crushed to a smaller size prior to the removal of ash from the coal. In yet another aspect of the invention, an air table is used to separate ash and coal in a fluidizing bed which does not require a fluidizing medium. In yet another aspect of the invention, the beneficiated coal product may be recombined with material that has been separated during the beneficiation process to obtain a desired calorific value.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
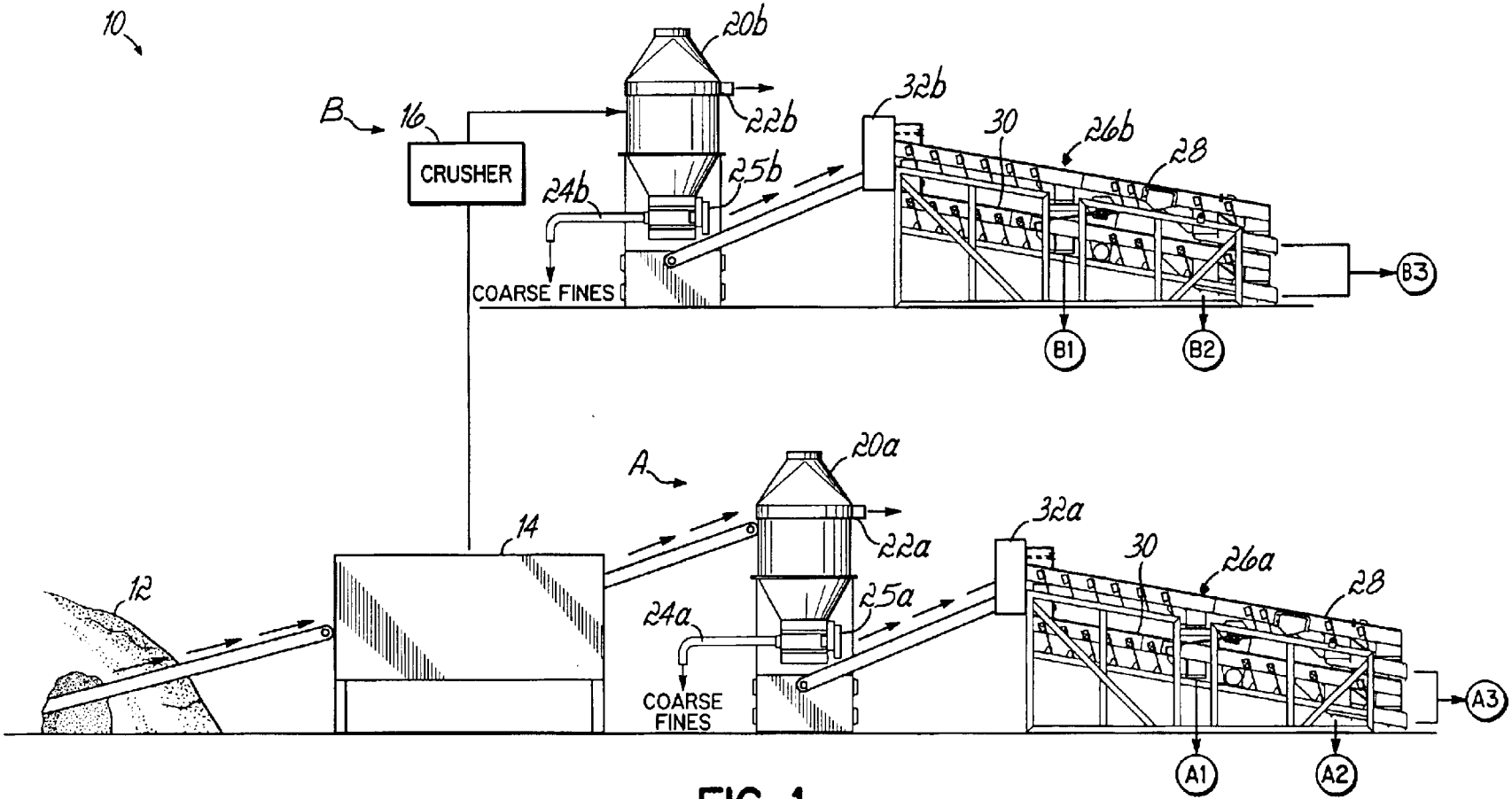
FIG. 1 is a schematic drawing depicting an exemplary apparatus and process of the present invention.
Figure 2:
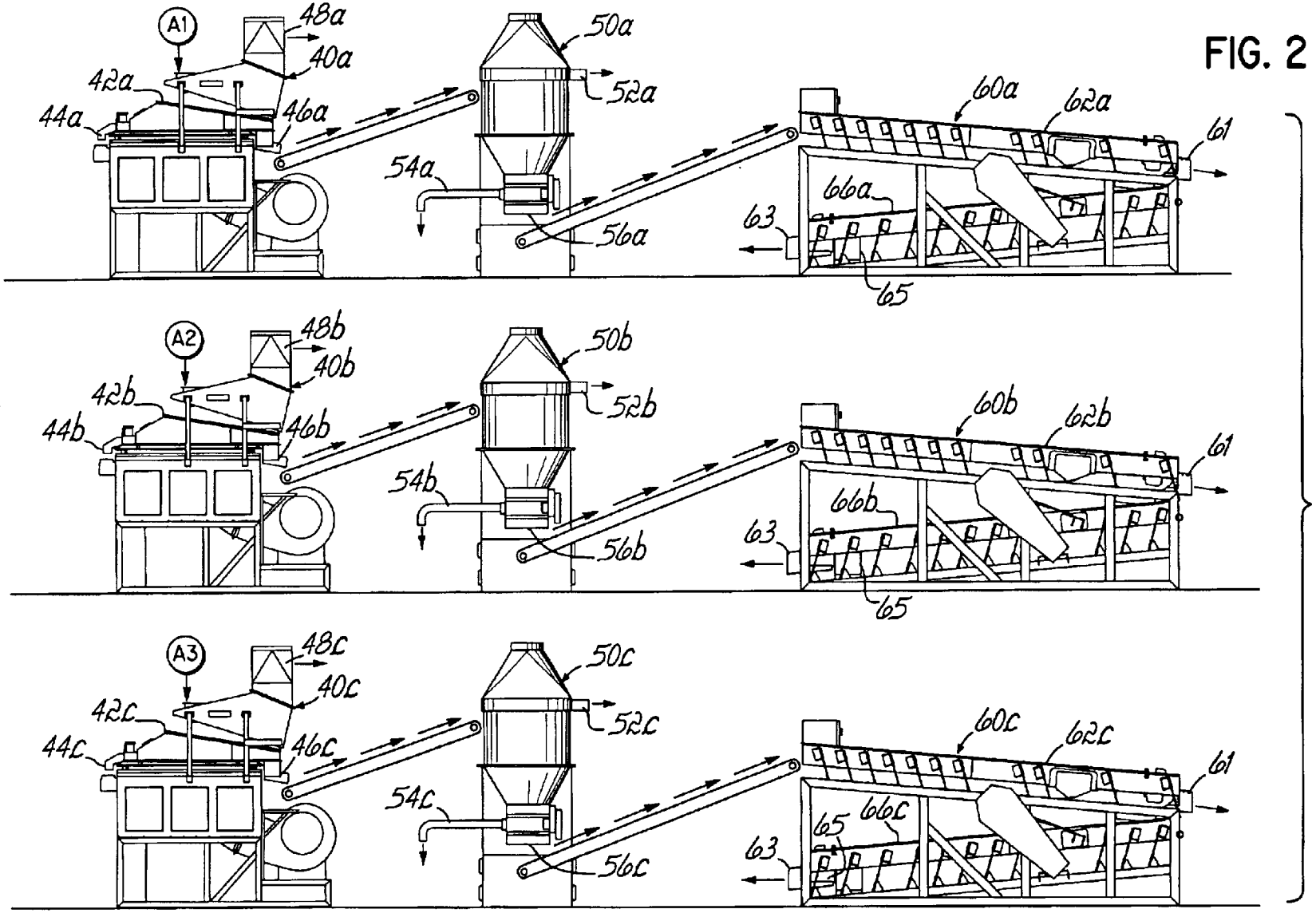
FIG. 2 is a schematic drawing depicting further components and steps of the apparatus and process of FIG. 1.
Figure 3:
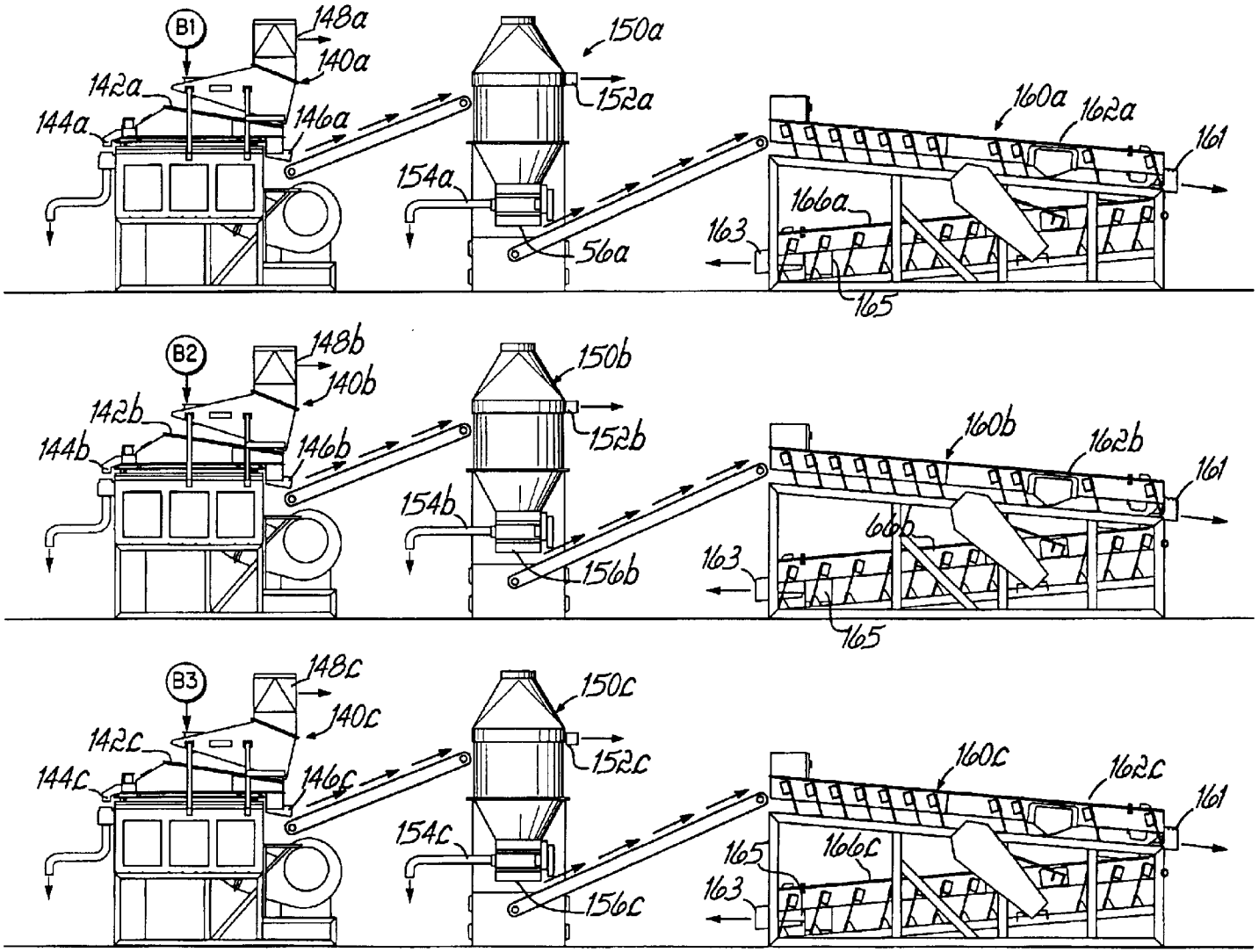
FIG. 3 is a schematic drawing depicting further components and steps of the apparatus and process of FIG. 1.

Referring to FIGS. 1–3, there is shown an exemplary apparatus 10 of the present invention for dry beneficiation of coal. Raw coal is delivered from a coal mine 12 to a high-frequency shaker 14 which classifies and separates the raw coal according to size. In the exemplary embodiment, the high-frequency shaker 14 separates the raw coal into a first group having a size which is greater than a desired maximum size and a second group having a size which is less than the desired maximum size. The desired maximum size may be determined according to a desired final beneficiated coal size or by the size of equipment downstream of the high-frequency shaker 14. FIG. 1 depicts a single high-frequency shaker 14 however, it will be understood by those skilled in the art that more than one shaker 14 may be used to classify the raw coal, as may be required. The first group of coal material separated by the high-frequency shaker 14 may be directed to a crusher 16 which reduces the size of the first group until it is less than the desired maximum size. In general, the first group of coal material separated by the high-frequency shaker 14 may have a higher ash content than the second group, and therefore it may be desired to process the first group of coal material in a line B which is similar to the line A for processing the second group, but which is maintained separate from line A. Because the two lines A, B are similar, only line A will be described below. Corresponding components of lines A and B are correspondingly numbered, varying only by a suffix letter which designates line A or B.

The first group of coal material exiting the crusher 16 and the second group of coal material are directed to devices 20*b*, 20*a*, respectively, which use pressurized air to separate the first and second groups into larger pieces of coal material and smaller particles, called fines, which may comprise ash and small particles of coal. Small light fines are generally removed through one outlet 22*a*, 22*b* by the pressurized air and larger, coarse fines are removed through a separate outlet 24*a*, 24*b*. In the exemplary apparatus shown in FIG. 1, the air separating devices 20*a*, 20*b* are depicted as aspirators, such as a Model 486 aspirator, available from Lewis M. Carter Manufacturing Co., Donalsonville, Ga. however it will be understood by those skilled in the art that the air separating devices 20*a*, 20*b* may be any other suitable devices which can separate out the coal fines from the larger coal material, such as cyclones or air legs.

The larger pieces of coal material exit the aspirators 20*a*, 20*b* at outlets 25*a*, 25*b* and are directed to shakers 26*a*, 26*b* which are configured to separate the larger pieces of coal material according to size into separate groups. The shakers 26*a*, 26*b* have at least one screen with round or slotted holes sized to separate the larger pieces of coal material into the various desired groups. In the exemplary embodiment shown, the shaker 26*a* separates the larger pieces of coal material into three groups A1, A2, and A3. Similarly, shaker 26*b* separates infed coal material into three separate groups B1, B2, and B3. In the exemplary embodiment shown, the shakers 26*a*, 26*b* have two decks 28, 30 for separating the larger pieces of coal material into the desired groups. Coal material from the aspirators 20*a*, 20*b* is divided by flow separators 32*a*, 32*b* wherein half the flow is directed to each of the two decks 28, 30 of the shakers 26*a*, 26*b*. This arrangement accommodates a high through-put without increasing the size of the shakers 26*a*, 26*b*. Accordingly, a commercially available shaker may be used, such as Model No. 8416D, available from Lewis M. Carter Manufacturing Co., Donalsonville, Ga.

Referring further to FIG. 2, each group of coal material A1, A2, A3 separated by the shaker 26*a* is directed to a respective air table 40*a*, 40*b*, 40*c*. The air tables 40*a*–40*c* and the remaining equipment downstream of the air tables are similar with respect to each group of coal material A1–A3 and B1–B3 to be processed, with the exception that the hole sizes in perforated screens which may be used with the equipment may vary, and/or the amplitudes and frequencies of vibration with which the devices are operated may vary to permit processing of the various sizes of coal material. Because the equipment for each line A, B downstream of the first shakers 26*a*, 26*b* is similar, only the equipment downstream of shaker 26*a* will be described. Equipment downstream of shaker 26*b* is numbered similar to respective equipment downstream of shaker 26*a*, but their numbers are in the 100s. For example, groups B1–B3 separated by shaker 26*b* are directed to air tables 140*a*, 140*b*, and 140*c*.

The groups of coal material A1–A3 are received by their respective air tables 40*a*–40*c* upon moveable beds 42*a*, 42*b*, 42*c* which may be inclined at one end. The beds 42*a*–42*c* have rippled surfaces and perforations which permit pressurized air to flow through the beds 42*a*–42*c* to fluidize the coal material. In an exemplary embodiment, the air tables 40*a*–40*c* fluidize the coal material without the need for a separate fluidizing media, such as magnetite or other similar particles, having a density intermediate the coal and ash. One such device is a Model No. 60AT air table, available from Lewis M. Carter Manufacturing Co., Donalsonville, Ga. As pressurized air fluidizes the coal material, the beds 42*a*–42*c* are vibrated in an eccentric fashion. The coal stratifies into an upper layer which comprises mostly coal and a lower layer which comprises mostly ash. The beds 42*a*–42*c* are inclined at one end and the vibratory motion of the beds 42*a*–42*c* causes the heavier, or denser ash to travel up the incline, where it exits the air tables 40*a*–40*c* from chutes 44*a*, 44*b*, 44*c*. The upper layer, comprising mostly coal, is drawn by gravity down the incline, where it exits the air tables 40*a*–40*c* at second chutes 46*a*, 46*b*, 46*c*. Coal fines may be drawn off by the pressurized air stream and collected at a separate outlet 48*a*, 48*b*, 48*c*.

Because some of the product fed to the air tables 40*a*–40*c* may include small, thin or flat ash which may be stratified with the coal to the upper layer and exit the air tables 40*a*–40*c* with the coal, the calorific value of coal material from the air tables 40*a*–40*c* generally is not at an optimum desired value. Therefore, the coal material may be directed to second shakers 60*a*, 60*b*, 60*c* to remove ash which has passed through the air tables 40*a*–40*c*, as will be described further below. In the exemplary embodiment, the coal material exiting the air tables 40*a*–40*c* is first directed to second air separating devices 50*a*, 50*b*, 50*c* to remove fines from the product exiting the air tables 40*a*–40*c* prior to entering the second shakers 60*a*, 60*b*, 60*c*. In the exemplary apparatus shown, the second air separators 50*a*–50*c* are aspirators, as described above, but may be any other air separating devices capable of separating the fines from the coal, such as cyclones or air legs. Second aspirators 50*a*–50*c* separate the coal material into fines, coarse fines, and larger pieces of coal material which exit the second aspirators through outlets 52*a*–52*c*, 54*a*–54*c*, and 56*a*–56*c*, respectively.

Figure 4:
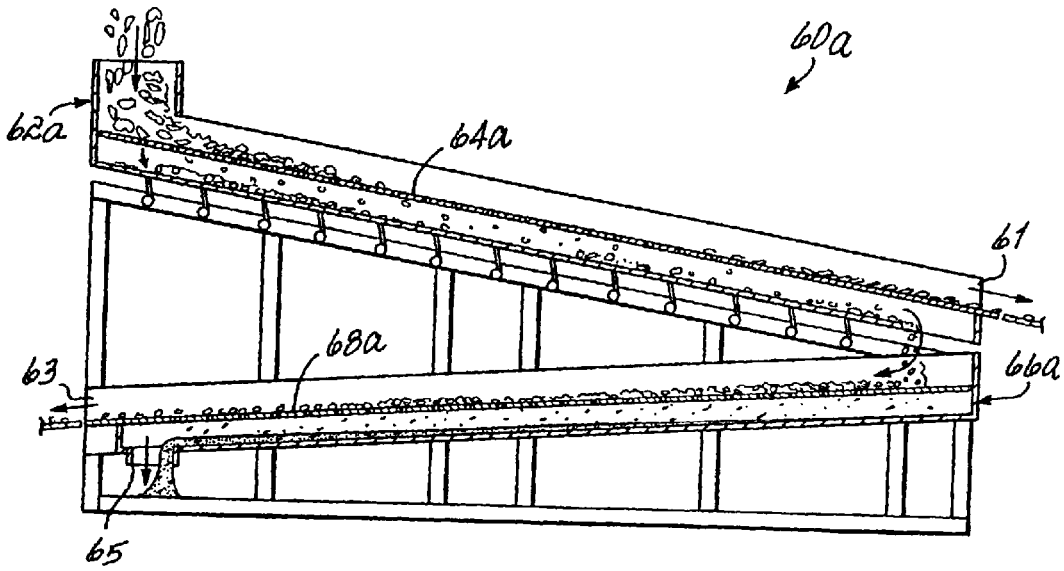
FIG. 4 is a schematic drawing of an exemplary shaker of the apparatus of FIG. 1.

The coal material from the air tables 40*a*–40*c*, or the second air separating devices 50*a*–50*c*, is directed to second shakers 60*a*–60*c* to further remove ash from the coal material by discriminating with respect to size. In the exemplary embodiment shown, the second shakers 60*a*–60*c* are reverse-flow shakers, such as model Number 8414R or 8416R, available from Lewis M. Carter Manufacturing Co., Donalsonville, Ga. Like the first shakers 26*a*–26*c*, the second shakers 60*a*–60*c* separate ash from infed coal material, utilizing screens having openings sized to pass material of a desired size. Referring further to FIG. 4, one exemplary second shaker 60*a* has a first deck 62*a* having a screen 64*a* with round holes, and second deck 66*a* having a screen 68*a* with elongated or slotted holes. The round holes of the first screen 64*a* on the first deck 62*a* are sized to pass coal material, while larger pieces of ash remain above the screen 64*a*. The larger pieces of ash are scalped from the top of the first screen 64*a* at an outlet 61. The coal material is then transferred to the second deck 66*a* where the screen 68*a* with elongated holes separates ash from the coal by thickness discrimination. Small, thin ash passes through the screen 68*a*, while coal passes over the screen 68*a* to exit the second shaker 60*a* at an outlet 63 as a cleaned coal product. Ash passing through screen 68*a* exits at an outlet 65.

Figure 5:
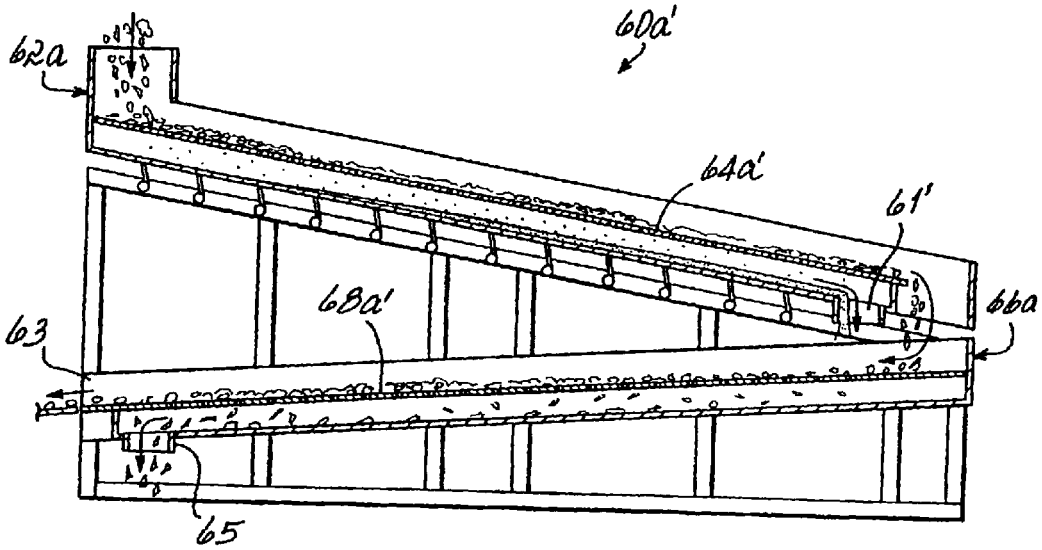
FIG. 5 is a schematic drawing a another exemplary shaker of the apparatus of FIG. 1.

Referring to FIG. 5, another exemplary second shaker 60*a*' has first deck 62*a* and a second deck 66*a* wherein screens 64*a*', 68*a*' on both decks 62*a*, 66*a* have elongated, or slotted holes. In this configuration, thin, flat ash passes through the elongated holes in screens 64*a*' and 68*a*' to exit outlets 61' and 65. Cleaned coal passes over screen 64*a*', is transferred to screen 68*a*', and exits the second shaker 60*a*' at outlet 63.

While the exemplary second shaker has been described as having a first deck with a round-hole screen and a second deck with a slotted screen, the screens may be varied to effectuate separation of ash from the coal by other arrangements as well. For example, the first and second decks may both have round-hole screens, or the decks may have screens with an alternating arrangement of round holes and slots. For any configuration, the sizes of the round or elongated holes are selected to separate ash and coal based on the size of clean coal desired. In general, the hole sizes of screens in the first shakers 26*a*, 26*b* and the first screens 64*a*–64*c* in the second shakers 60*a*–60*c* are selected to be slightly undersize of the holes in the second screens 68*a*–68*c* of the second shakers 60*a*–60*c* to reduce the amount of pure coal which may pass with removed ash in the early stages of the cleaning process when the ash and coal may be close in size.

Some pure coal inherently is removed with ash in the process described above, however, the increased quality of the finished, clean coal product offsets the loss, generally translating to an increased market value. In addition, coal lost during the cleaning process may be reclaimed by processing the removed ash-coal mixture in a recovery system. In an exemplary embodiment, the recovery system comprises a first aspirator, an air table, a second aspirator, and a reverse-flow shaker similar to those described above.

The coal which exits the second shakers 60*a*–60*c* is a clean coal product which may be utilized by various coal consumers. In general, it has been found that coal processed by the equipment 10 as described above, has a calorific value which is higher than coal which has been processed by prior dry beneficiation methods.

A method for dry beneficiation of coal using the apparatus 10 described above will now be discussed. Raw coal from the coal mine 12 may generally be separated on a high-frequency shaker 14 and processed through a crusher 16, if necessary, to obtain appropriately-sized coal which may be processed by the equipment 10. The raw coal is separated using pressurized air to obtain coal fines, coarse coal fines, and larger pieces of coal. The larger pieces of coal are separated according to size into at least one first group. Each first group is conveyed to a separate air table where the first group is separated into at least one second group comprising mostly ash, and one third group comprising mostly coal. In an exemplary embodiment, ash is further removed from each third group using pressurized air, and thin ash is removed from each third group using a size-discriminating device to obtain beneficiated coal.

Figure 6:
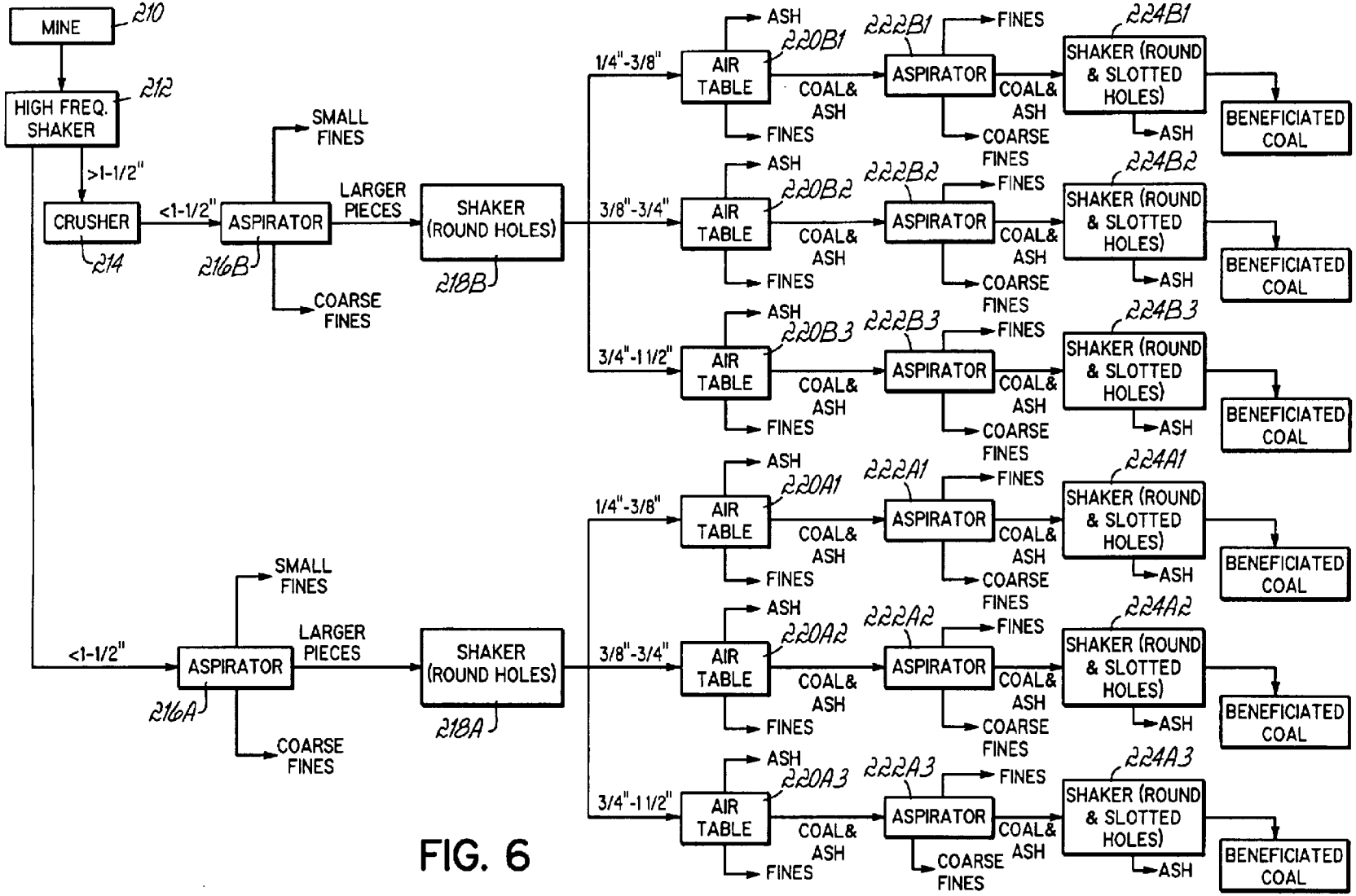
FIG. 6 is a flow chart of an exemplary method of the invention.

Referring to FIG. 6, an exemplary method for dry beneficiation of coal according to the present invention will be described. Raw coal from a coal mine 210 is delivered to a high frequency shaker 212 which separates the raw coal into a first group having a size which is greater than approximately 1½ inches and a second group which has a size which is less than approximately 1½ inches. The first group of coal is conveyed to a crusher 214 which reduces the size of the first group of coal by crushing the first group until the size is less than approximately 1½ inches. The second group of coal from the aspirator and the first group of coal, having been crushed in crusher 214, are directed to aspirators 216*a*, 216*b* which separate the input coal material into small fines, coarse fines, and larger pieces of coal. The larger pieces of coal from aspirators 216*a*, 216*b* are directed to shakers 218*a*, 218*b* which have round holes sized to seperate the infed coal into groups A1, A2, A3, and B1, B2, B3, according to size. Groups A1 and B1 have a size of approximately ¼ inch to approximately ⅜ inch. Groups A2 and B2 have a size of approximately ⅜ inch to approximately ¾ inch, and Groups A3 and B3 have a size of approximately ¾ inch to approximately 1½ inches.

The coal separated by shakers 218*a*, 218*b* is then directed to respective air tables 220A1, 220A2, 220A3, and 220B1, 220B2, 220B3 which fluidize the infed coal material to separate ash and fines from the coal material. Coal and ash from air tables 220A1–220A3 and 220B1–220B3 are conveyed to aspirators 222A1–222A3 and 222B1–222B3, respectively to further remove fines from the material. Coal and ash from the aspirators 222A1–222A3 and 222B1–222B3 are then directed to second shakers 224A1–224A3 and 224B1–224B3, respectively. Shakers 224A1–224A3 and 224B1–224B3 have screens with round and slotted holes to further remove ash from the coal material as described above. The product exiting shakers 224A1–224A3 and 224B1–224B3 is a beneficiated coal product.

One specific example of raw coal which has been beneficiated in an apparatus according to the present invention will now be described. Raw coal was obtained from a mine near Central City, Ky. The raw coal from the mine was measured to have a calorific value of approximately 10,000 to 10,250 Btu/lb, an ash content of approximately 25% and a sulfur content of approximately 3.5%. The raw coal was separated by size in a high-frequency shaker and raw coal having a size of less than approximately 1½ inches was fed to an aspirator. The aspirator removed small and coarse fines from the infed coal material and conveyed the larger pieces of coal to an LMC Model No. 8416D shaker having screens with round holes. The shaker separated the infed coal material into three groups. The first group had a size of approximately ¼ inch to approximately ⅜-inch, the second group had a size of approximately ⅜-inch to ¾-inch, and the third group had a size of approximately ¾-inch to 1½ inches. Each group of coal was then processed individually on an air table (LMC Model No. 60AT) to further remove ash and fines from the coal material. Coal material from each group was tested upon exiting the air table to evaluate the quality of the coal. Coal from the first group was determined to have a calorific value of approximately 12,006 Btu/lb, an ash content of 7.8%, and a sulfur content of 3.0%. The coal from the second group was determined to have a calorific value of approximately 11,300 to 12,000 Btu/lb, an ash content of approximately 9% to 10%, and a sulfur content of approximately 3.4%. Coal from the third group was determined to have a calorific value of approximately 12,075 Btu/lb, an ash content of approximately 9%, and a sulfur content of approximately 3.1%. The coal material was then transferred to an aspirator (LMC Model No. 726) to further remove fines from the coal material. Finally, the coal material was conveyed to a reverse flow shaker (LMC Model No. 8416R) to further separate ash from the coal material. The beneficiated coal exiting the second shaker was measured to have a calorific value of approximately 12,000 to 12,550 Btu/lb, an ash content of approximately 9%, and a sulfur content of approximately 3.2%.

While the present invention has been illustrated by the description of the various embodiments thereof, and while the embodiments have been described in considerable detail, it is not intended to restrict or in any way limit the scope of the appended claims to such detail. For example, various components of the exemplary apparatus described herein may not be required to obtain a desired calorific value of the beneficiated coal and may be removed from the system. Likewise, a particular step of the exemplary method described herein may not be required to obtain a desired calorific value and may thus be eliminated.

Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A method of beneficiating coal, comprising the steps of:

receiving coal material on an air table which operates without a fluidizing media;

separating the coal material on the air table into at least one group comprising mostly ash and at least one group comprising mostly coal;

separating raw coal, using pressurized air, to obtain coal fines, coarse coal fines, and larger pieces of coal; and transferring the larger pieces of coal to the air table for processing.

2. A method of beneficiating coal, comprising the steps of:

receiving coal material on an air table which operates without a fluidizing media;

separating the coal material on the air table into at least one group comprising mostly ash and at least one group comprising mostly coal;

transferring the group comprising mostly coal from the air table to a size discriminating device; and separating small, thin ash from the group using the size discriminating device to obtain beneficiated coal.

3. The method of claim 2, further comprising:

separating coal material on a shaker, according to size, into at least one group; and transferring the group to the air table for processing.

4. A method of beneficiating coal, comprising the steps of:

separating coal material, using pressurized air, to obtain coal fines, coarse coal fines, and larger pieces of coal;

separating the larger pieces of coal, according to size, into at least one first group;

conveying each separated first group to an air table;

separating each first group, on its respective air table, into at least one second group comprising mostly ash and at least one third group comprising mostly coal; and separating small, thin ash from each third group using a size discriminating device to obtain beneficiated coal.

5. The method of claim 4, wherein said step of separating the larger pieces of coal, according to size, is performed on a shaker having screens with round holes sized to separate the coal according to desired size ranges.

6. The method of claim 4, wherein said step of separating small, thin ash from each third group is performed on a shaker having screens with elongated slots.

7. The method of claim 4, wherein the air table does not utilize a fluidizing media.

8. The method of claim 4, further comprising:

removing ash, which passed with the coal from the air table, from each third group using an air separator.

9. The method of claim 4, further comprising:

selectively combining beneficiated coal with portions of previously separated product to obtain an aggregate having a desired calorific value.

10. A method of beneficiating coal, comprising the steps of:

classifying raw coal by size into a first group having a size greater than about 1½ inches and a second group having a size not greater than about 1½ inches;

separating the coal from the second group in an aspirator to obtain coal fines and a third group comprising larger pieces of coal;

separating the third group by size, using a screen having round holes, into a fourth group having a size of approximately ¼-inch to approximately ⅜-inch, a fifth group having a size of approximately ⅜-inch to approximately ¾-inch, and a sixth group having a size of approximately ¾-inch to approximately 1½ inches;

conveying the fourth, fifth, and sixth groups to separate air tables;

separating ash and coal fines from the fourth, fifth, and sixth groups on their respective air tables; and separating small, thin ash from the fourth, fifth, and sixth groups using shakers having screens with elongate holes to obtain beneficiated coal.

11. The method of claim 10, further comprising:

crushing raw coal from the first group until it has a size not greater than about 1½ inches; and recombining the crushed coal with the second group so that the crushed coal and the second group are separated together in the aspirator.

12. The method of claim 10, further comprising:

crushing raw coal from the first group until it has a size not greater than about 1½ inches;

separating the coal from the crushed raw coal in a second aspirator to obtain coal fines and a seventh group comprising larger pieces of coal;

separating the seventh group by size, using a screen having round holes, into an eighth group having a size of approximately 1¼-inch to approximately ⅜-inch, a ninth group having a size of approximately ⅜-inch to approximately ¾-inch, and a tenth group having a size of approximately ¾-inch to approximately 1½ inches;

conveying the eighth, ninth, and tenth groups to separate air tables;

separating ash and coal fines from the eighth, ninth, and tenth groups on their respective air tables; and separating small, thin ash from the eighth, ninth, and tenth groups using shakers having a screens with elongate holes.

13. The method of claim 10, further comprising:

removing ash, which passed with the coal from the air tables, using an air separator.

14. The method of claim 10, further comprising:

selectively combining the beneficiated coal with portions of previously separated product to obtain an aggregate having a desired calorific value.

15. A method of beneficiating coal, comprising the steps of:

separating raw coal having a calorific value of less than approximately 12,000 Btu/lb, using pressurized air, to obtain coal fines, coarse coal fines, and larger pieces of coal;

separating the larger pieces of coal, according to size, into at least one first group;

conveying each separated first group to an air table;

separating each first group, on its respective air table, into at least one second group comprising mostly ash and at least one third group comprising mostly coal; and separating small, thin ash from each third group using a size discriminating device to obtain beneficiated coal, having a calorific value of at least approximately 12,000 Btu/lb.

16. The method of claim 15, wherein said step of separating the larger pieces of coal, according to size, is performed on a shaker having screens with round holes sized to separate the coal according to desired size ranges.

17. The method of claim 15, wherein said step of separating small, thin ash from each third group is performed on a shaker having screens with elongated slots.

18. The method of claim 15, wherein the air table does not utilize a fluidizing media.

19. The method of claim 15, further comprising:

removing ash, which passed with the coal from the air table, from each third group using an air separator.

20. The method of claim 15, further comprising:

selectively combining beneficiated coal with portions of previously separated product to obtain an aggregate having a desired calorific value.

21. A method of beneficiating coal, comprising the steps of:

separating raw coal having a calorific value not greater than approximately 10,000 Btu/lb, using pressurized air, to obtain coal fines, coarse coal fines, and larger pieces of coal;

separating the larger pieces of coal, according to size, into at least one first group;

conveying each separated first group to an air table;

separating each first group, on its respective air table, into at least one second group comprising mostly ash and at least one third group comprising mostly coal; and separating small, thin ash from each third group using a size discriminating device to obtain beneficiated coal, having a calorific value of at least approximately 12,000 Btu/lb.

22. A method of beneficiating coal having a calorific value not greater than approximately 10,000 Btu/lb, comprising the steps of:

classifying raw coal by size into a first group having a size greater than about 1½ inches and a second group having a size not greater than about 1½ inches;

separating the coal from the second group in an aspirator to obtain coal fines and a third group comprising larger pieces of coal;

separating the third group by size, using a screen having round holes, into a fourth group having a size of approximately ¼-inch to approximately ⅜-inch, a fifth group having a size of approximately ⅜-inch to approximately ¾-inch, and a sixth group having a size of approximately ¾-inch to approximately 1½ inches;

conveying the fourth, fifth, and sixth groups to separate air tables;

separating ash and coal fines from the fourth, fifth, and sixth groups on their respective air tables; and separating small, thin ash from the fourth, fifth, and sixth groups using shakers having screens with elongate holes to obtain beneficiated coal having a calorific value of at least approximately 12,000 Btu/lb.

23. The method of claim 22, further comprising:

crushing raw coal from the first group until it has a size not greater than about 1½ inches; and recombining the crushed coal with the second group so that the crushed coal and the second group are separated together in the aspirator.

24. The method of claim 22, further comprising:

crushing raw coal from the first group until it has a size not greater than about 1½ inches;

separating the coal from the crushed raw coal in a second aspirator to obtain coal fines and a seventh group comprising larger pieces of coal;

separating the seventh group by size, using a screen having round holes, into an eighth group having a size of approximately ¼-inch to approximately ⅜-inch, a ninth group having a size of approximately ⅜-inch to approximately ¾-inch, and a tenth group having a size of approximately ¾-inch to approximately 1½ inches;

conveying the eighth, ninth, and tenth groups to separate air tables;

separating ash and coal fines from the eighth, ninth, and tenth groups on their respective air tables; and separating small, thin ash from the eighth, ninth, and tenth groups using shakers having a screens with elongate holes.

25. The method of claim 22, further comprising:

removing ash, which passed with the coal from the air tables, using an air separator.

26. The method of claim 22, further comprising:

selectively combining the beneficiated coal with portions of previously separated product to obtain an aggregate having a desired calorific value.-

27. An apparatus for dry beneficiation of coal, comprising:

at least one air table adapted receive infed coal material and to fluidize the infed coal and separate the coal, according to mass, into a first group comprising mostly ash and a second group comprising mostly coal, said air table operating without a fluidizing media; and at least one second shaker downstream of said air table and adapted to receive the second group from the air table and separate the second group, according to thickness, into beneficiated coal and small flat ash.

28. An apparatus for dry beneficiation of coal, comprising:

at least one air table adapted receive infed coal material and to fluidize the infed coal and separate the coal, according to mass, into a first group comprising mostly ash and a second group comprising mostly coal, said air table operating without a fluidizing media; and at least one aspirator upstream of said air table adapted to receive raw coal which has been classified according to size and to pneumatically separate the raw coal into coal fines and coarse coal fines which are removed from processing, and larger pieces of coal which are transferred to said air table.

29. The apparatus of claim 28, further comprising:

at least one first shaker upstream of said air table and in communication with said aspirator, said first shaker adapted to receive the larger pieces of coal from said aspirator, said first shaker including at least one screen having round holes sized to separate the larger pieces of coal, according to size, into at least two groups for subsequent processing by said air table; and at least one second shaker downstream of said air table and adapted to receive the second group and separate the second group, according to thickness, into beneficiated coal and small flat ash.

30. An apparatus for dry beneficiation of coal, comprising:

at least one first aspirator adapted to receive raw coal which has been classified according to size and to pneumatically separate the raw coal into coal fines, coarse coal fines, and larger pieces of coal;

at least one first shaker in communication with said first aspirator and adapted to receive the larger pieces of coal from said first aspirator, said first shaker including at least one screen having round holes sized to separate the larger pieces of coal, according to size, into at least two first groups;

at least one air table in communication with said first shaker to receive a first group of coal which has been separated by said first shaker, said air table adapted to fluidize the first group of coal and separate the first group, according to mass, into a second group comprising mostly ash and a third group comprising mostly coal; and at least one second shaker in communication with said air table to receive the third group and separate the third group, according to thickness, into beneficiated coal and small flat ash.

31. The apparatus of claim 30, further comprising at least one second aspirator downstream of said air table and upstream of said second shaker, said second aspirator adapted to receive the third group from said air table and pneumatically remove coal fines and small flat ash from the third group prior to transferring the third group to said second shaker.

32. The apparatus of claim 30, wherein said first shaker comprises at least one screen having round holes sized to separate the larger pieces of coal, according to size.

33. The apparatus of claim 30, wherein said second shaker comprises at least one screen having elongated slots sized to separate the third group according to thickness.

34. The apparatus of claim 30, wherein said air table does not utilize a fluidizing media.

* * * * *